US006334611B1

(12) United States Patent
Koo

(10) Patent No.: US 6,334,611 B1
(45) Date of Patent: Jan. 1, 2002

(54) PAPER DISCHARGING APPARATUS FOR PRINTER

(75) Inventor: Sang-heon Koo, Yongin (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/484,696

(22) Filed: Jan. 18, 2000

(30) Foreign Application Priority Data

Jan. 18, 1999 (KR) ..... 99-1254

(51) Int. Cl.[7] ..... B65H 39/10; B65H 33/04; B65H 39/02

(52) U.S. Cl. ..... 271/296; 270/58.18

(58) Field of Search ..... 271/296, 302; 270/58.18, 58.19

(56) References Cited

U.S. PATENT DOCUMENTS 5,603,494 A * 2/1997 Baker et al. ..... 271/296
5,720,479 A * 2/1998 Yamaguchi et al. .... 271/288 X
5,931,464 A * 8/1999 Shimizu et al. ..... 271/296

* cited by examiner

*Primary Examiner*—Christopher P. Ellis
*Assistant Examiner*—Kenneth W Bower
(74) *Attorney, Agent, or Firm*—Sughrue Mion, PLLC

(57) ABSTRACT

A paper discharging apparatus for a printer includes a movement path having a first movement track and a second movement track for independently guiding paper printed in an image forming unit in a printer body and means for branching the movement path and allowing the printed paper to selectively enter the first or second movement track. A first indexer is installed in the printer body, which clamps a first sheet of paper that has passed through the first movement track, and which moves to a first selected discharge tray to discharge the paper thereto. A second indexer is installed in the printer body, which clamps a second sheet of paper that has passed through the second movement track, and which moves to a second selected discharge tray to discharge the paper thereto. Means are provided for elevating the first and the second indexers, and a controller controls the driving of the elevating means and the first and the second indexers.

13 Claims, 4 Drawing Sheets

PAPER DISCHARGING APPARATUS FOR PRINTER

BACKGROUND OF THE INVENTION

1. Field of the Invention

The present invention relates to a paper discharging apparatus for a printer that transfers sheets of paper from an image printer to a plurality of paper discharging trays.

2. Description of the Related Art

In general, a printer such as a laser printer or a copier, as shown in FIG. 1, includes an image forming unit 3 for forming an image on a photoreceptor belt 2 and printing the formed image on a sheet of paper P. The paper P having a printed image is discharged to the outside of a printer body 1 by a paper discharging apparatus.

The paper discharging apparatus includes a plurality of discharge trays 4 installed in the exterior side of the printer body 1, and a transfer means for selectively transferring the paper P from the image forming unit 3 to the discharge trays 4.

The paper P is selectively discharged to one of the plurality of discharge trays 4 according to the printed image. For example, in the case where an identical image is printed onto a plurality of sheets, the sheets of printed paper are transferred to the respective discharge trays 4 to then be sorted.

The transfer means includes a pair of pulleys 5 rotatably installed in the upper and lower portions of the printer body 1, a belt 6 supported by the pulleys 5, a stepping motor 8 for driving the pulleys 5, and an indexer 7 installed on the belt 6, for clamping paper P printed and transferred. The indexer 7 is constituted by a pair of rollers 7*a* which rotate in contact with each other, and a motor 7*b* for rotating the rollers 7*a*.

In the above-described configuration, the paper P printed in the image forming unit 3 is guided by a guide 9, and then clamped between rollers 7*a* of the indexer 7. As the belt 6 travels, the indexer 7 elevates to reach a selected discharge tray 4 as shown in phantom in FIG. 1. Then, the paper P is discharged to the selected discharge tray 4 by rotation of the rollers 7*a*.

Although such conventional devices are generally thought to be acceptably, they are not without shortcomings. In particular, paper discharge occurs at a rapid rate, and therefore the indexer 7 cannot properly clamp a subsequent sheet of paper. This phenomenon is especially problematic when paper is discharged to the lowermost discharge tray 4 because the movement speed of the indexer 7 cannot catch up with the paper discharge speed from the guide 9.

SUMMARY OF THE INVENTION

An object of the present invention is to provide an improved paper discharging apparatus for a printer, which rapidly transfers successively discharged sheets of paper to discharge trays.

Accordingly, to achieve the above objective, a paper discharging apparatus for a printer includes a movement path having a first movement track and a second movement track for independently guiding paper printed in an image forming unit in a printer body. A means is provided for branching the movement path and allowing the printed paper to selectively enter the first or second movement track. A first indexer is elevatably installed in the printer body, for clamping a first sheet of paper that has passed through the first movement track and moving to a first selected discharge tray to discharge the paper thereto. A second indexer is elevatably installed in the printer body, for clamping a second sheet of paper that has passed through the second movement track and moving to a next selected discharge tray to discharge the paper thereto. A means is provided for elevating the first and second indexers, and a controller controls the driving of the elevating means and the first and second indexers.

Each of the elevating means preferably includes a pair of belts for supporting the corresponding indexer, pulleys installed in the upper and lower portions of the printer body to support the belts, and a stepping motor for rotating the pulleys.

The first indexer may include first brackets fixed on the belts, a pair of first clamping rollers rotatably mounted on the first brackets, for clamping the first sheet of paper and discharging the clamped paper to the first discharge tray, a first guide plate installed in the first brackets, for guiding the first sheet of paper discharged by the first clamping roller to the first discharge tray, and a first motor for driving the first clamping rollers.

The second indexer may include second brackets fixed on the belts, a pair of second clamping rollers rotatably mounted on the second brackets, for clamping the second sheet of paper and discharging the clamped paper to the second discharge tray, a second guide plate slidably installed in the second brackets so as to extend and retract toward and away from the discharge trays, for guiding the paper discharged from the second clamping rollers to the second discharge tray, a second motor for driving the second clamping rollers, and means for driving the second guide plate.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 1:
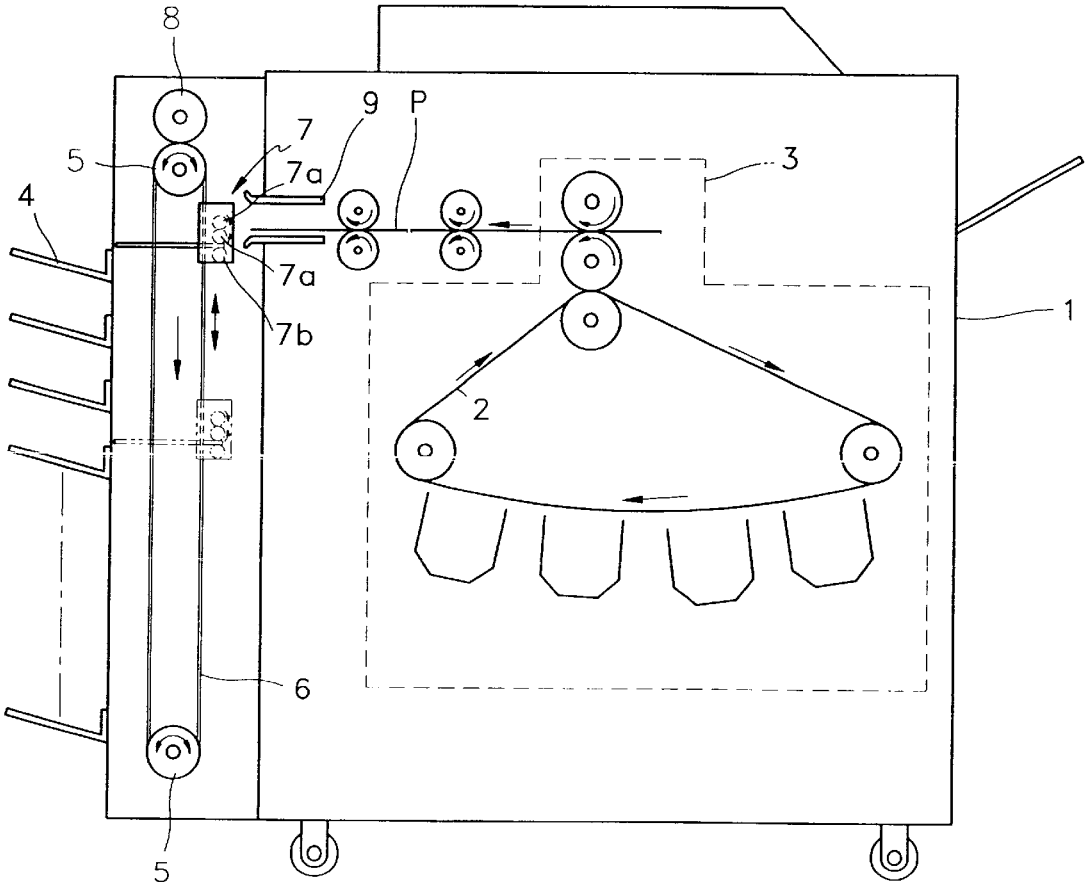
FIG. 1 (PRIOR ART)
FIG. 1 is a schematic diagram illustrating a printer employing a conventional paper discharging apparatus.
Figure 2:
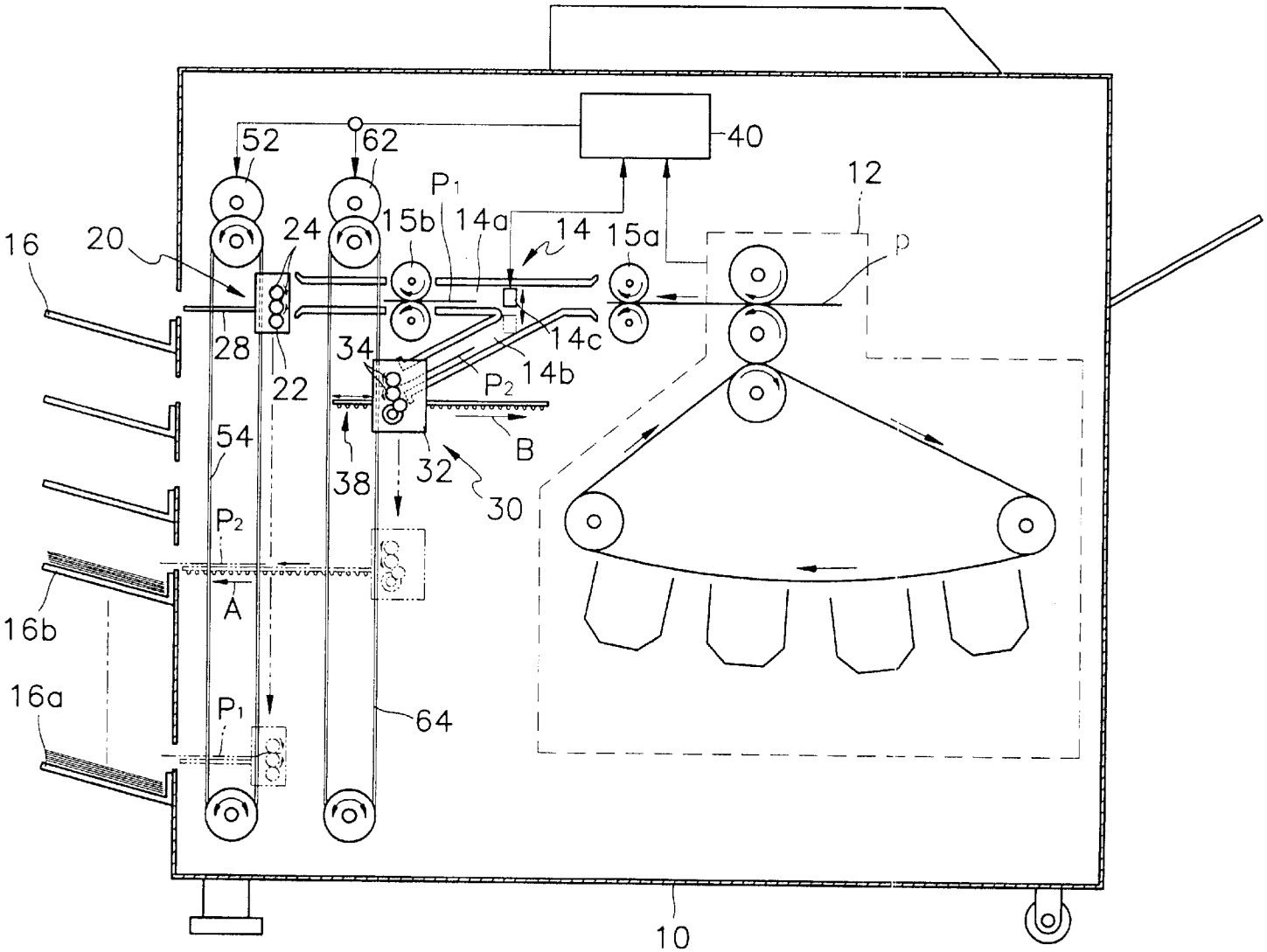
FIG. 2 is a schematic diagram illustrating a printer employing a paper discharging apparatus according to an embodiment of the present invention.

Referring to FIG. 2, a paper discharging apparatus according to one embodiment of the present invention includes a movement path 14 along which paper P (on which an image is printed in an image forming unit 12) moves, a plurality of discharge trays 16 installed on the exterior side of a printer body 10, first and second indexers 20 and 30, respectively, elevatably installed in the printer body 10, means for elevating the first and second indexers 20 and 30, and a controller 40 for controlling the driving of the elevating means and the first and second indexers 20 and 30.

The movement path 14 is branched off into a plurality of movement tracks, for example, first and second movement tracks 14*a* and 14*b*, respectively. The first and second movement tracks 14*a* and 14*b* have ends at which the indexers 20 and 30 are correspondingly installed. A transfer roller 15*a* for transferring the paper P is installed at an entrance of the movement path 14. If the movement path 14 is long, another transfer roller 15*b* may be installed in the middle of the movement path 14.

A solenoid shutter 14*c* is provided at the branching part of the first and second movement tracks 14*a* and 14*b*. The shutter 14*c* allows the printed paper P to selectively enter one of the first and second movement tracks 14*a* and 14*b* by the control of the controller 40.

Figure 3:
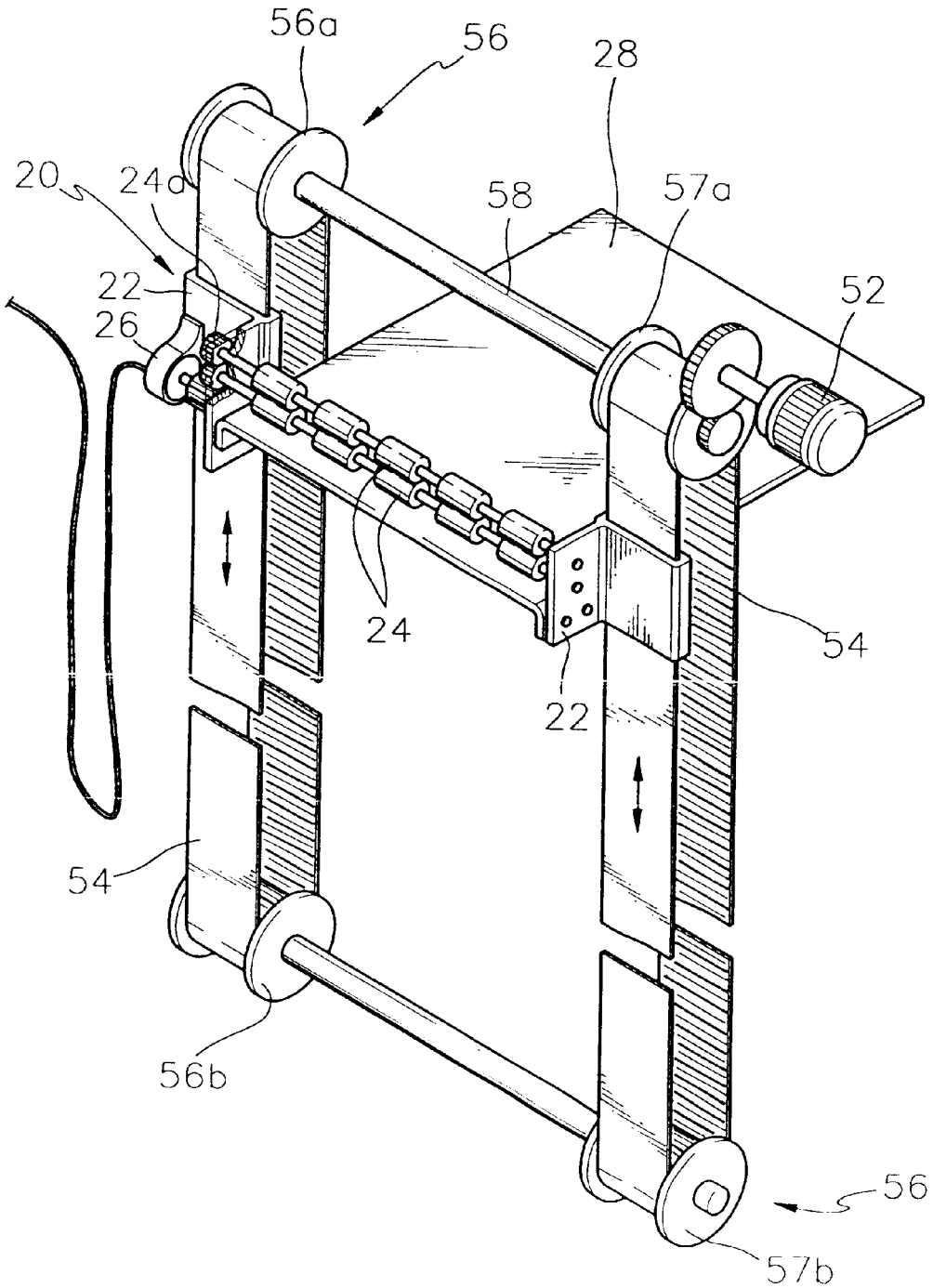
FIG. 3 is a schematic perspective view illustrating a first indexer and elevating means shown in FIG. 2.

The first indexer 20, as shown in FIG. 3, includes first brackets 22 fixed on a pair of belts 54 at the same height with each other, a pair of first clamping rollers 24 rotatably mounted on the first brackets 22, and a first guide plate 28 installed in the first brackets 22, for guiding paper. Also, a first motor 26, for driving the first clamping rollers 24 by a first interlocking gear 24*a*, is installed on the first brackets 22.

In this embodiment, when the second movement track 14*b* is located lower than the first movement track 14*a*, the movement distance of the second indexer 30 is shorter than that of the first indexer 20.

Figure 4:
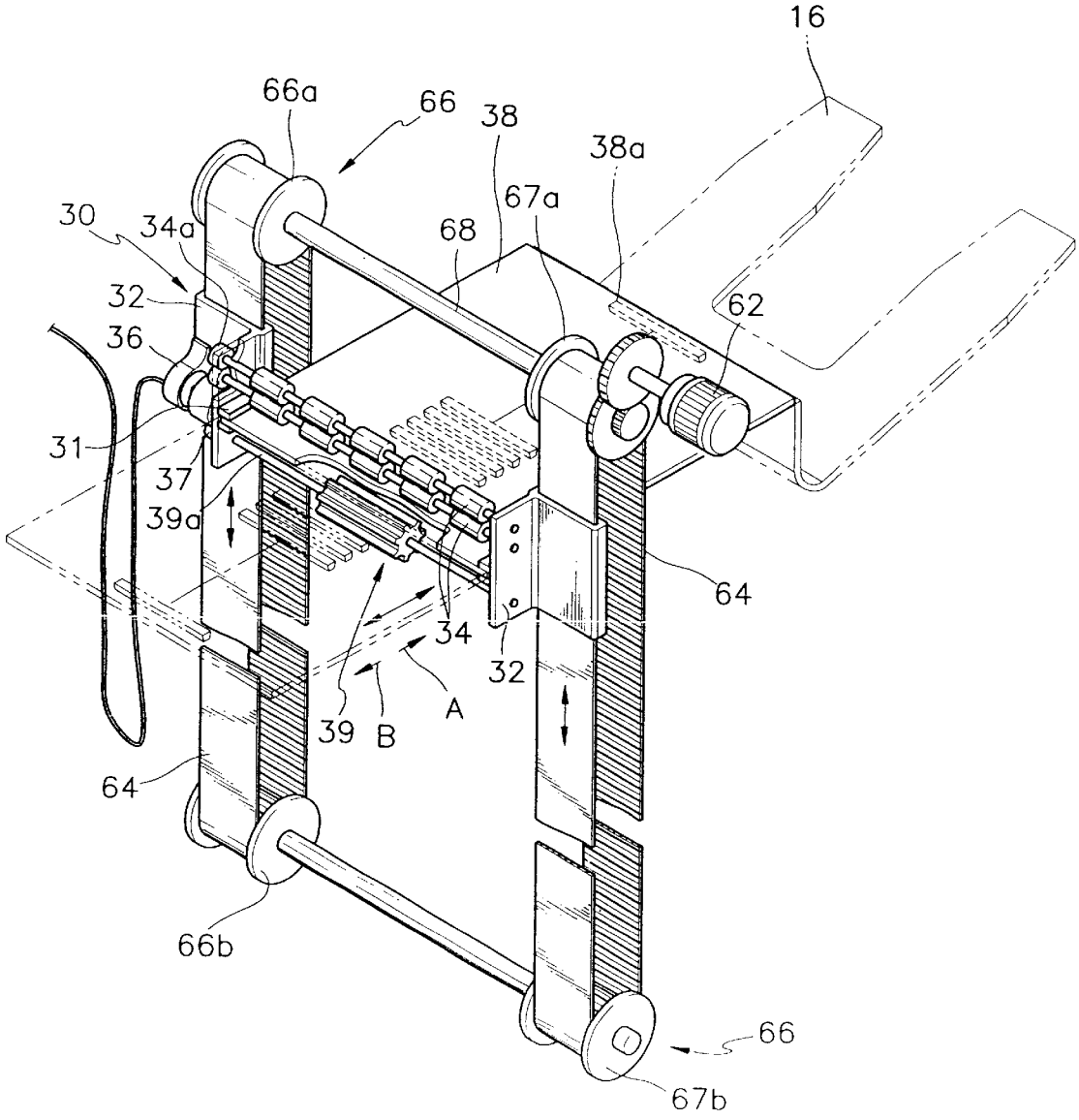
FIG. 4 is a schematic perspective view illustrating a second indexer and elevating means shown in FIG. 2.

As shown in FIG. 4, the second indexer 30 includes second brackets 32 fixed on a pair of belts 64 at the same height with each other, a pair of second clamping rollers 34 rotatably mounted on the second brackets 32, a second motor 36, for driving the second clamping rollers 34 by a pair of second interlocking gears 34*a*, a second guide plate 38 slidably installed in the second brackets 32 by a guide 31, and means for driving the second guide plate 38.

The second guide plate 38, for guiding the paper clamped by the second clamping rollers 34 and discharged to the discharge trays 16, is installed for movement toward and away from the discharge trays 16. That is, the guide plate 38 is moveable in directions A and B, so as to avoid interfering with the first indexer 20.

The driving means (for the second guide plate 38) includes a rack gear 38*a* formed on the bottom face of the second guide plate 38, a pinion gear 39 rotatably installed on the second brackets 32 so as to be engaged to the rack gear 38*a*, and a clutch 37 connected to a shaft 39*a* of the pinion gear 39. The clutch 37 is controlled by the controller 40 and selectively transfers a driving force of the second motor 36 to the shaft 39*a*.

As shown in FIGS. 3 and 4, the means for elevating the first and second indexers 20 and 30 includes stepping motors 52 and 62, respectively, a pair of belts 54 and 64, respectively, for supporting the first and second indexers 20 and 30, pulleys 56*a*, 57*a* and 66*a*, 67*a*, respectively, installed in the upper portion of the printer body 10, and pulleys 56*b*, 57*b* and 66*b*, 67*b*, respectively, installed in the lower portion of the printer body 10. The pulleys support the belts 54 and 64. Ends of the pulley shafts 58 and 68 are respectively coupled to rotation shafts of the stepping motors 52 and 62.

The paper discharge apparatus according to this embodiment of the present invention operates as follows.

The paper P printed in the image forming unit 12 is transferred by the transfer roller 15*a* into the movement path 14. The solenoid shutter 14*c* selectively opens or closes the first and second movement tracks 14*a* and 14*b* so that the paper P is introduced to one of the first and second movement tracks 14*a* and 14*b* according to the printing sequence. For example, as shown in FIG. 2, when a first sheet of paper P1 (which is printed first) enters the movement path 14, the solenoid shutter 14*c* is positioned (as shown in phantom) to open the first movement track 14*a* and close the second movement track 14*b*. Thus, the first sheet of paper P1 enters into the first movement track 14*a*. Subsequently, when a second sheet of paper P2 (which is printed second) enters the movement path 14, the solenoid shutter 14*c* is repositioned (as shown in solid lines) to close the first movement track 14*a* and open the second movement track 14*b*. Thus, the second sheet of paper P2 enters into the second movement track 14*b*.

The paper P1, having passed through the first movement track 14*a*, is clamped between the first clamping rollers 24 of the first indexer 20 positioned at the end of the first movement track 14*a*. In this state, the pulley 56*a* and 57*a* are rotated by the stepping motor 52 to lower the first indexer 20 fixed on the belt 54 to a selected discharge tray 16*a*.

The first indexer 20 moves to the desired discharge tray 16*a* and stops. The first clamping rollers 24 are rotated to discharge the paper P1 to the discharge tray 16*a* via the first guide plate 28. Then, the stepping motor 52 is rotated in reverse to move the first indexer 20 to its original position.

The paper P2, having passed through the second movement track 14*b*, is clamped between the second clamping rollers 34 of the second indexer 30. Next, the pulleys 66*a* and 67*a* are rotated by the stepping motor 62, to lower the second indexer 30 to a position corresponding to a selected discharge tray 16*b*. Thus far, the second guide plate 38 remains retracted in the direction B (See FIG. 4) so as to avoid interfering with the first indexer 20.

When the second indexer 30 reaches the selected discharge tray 16*b*, the pinion gear 39, rotated by the second motor 36 and the clutch 37, advances the second guide plate 38 in the direction A so that the end of the second guide plate 38 is positioned to correspond to the discharge tray 16*b*. Subsequently, the second clamping rollers 34 are rotated to discharge the clamped paper P2 across the second guide plate 38 and into the discharge tray 16*b*.

After the paper P2 is discharged, the clutch 37 is driven to rotate the pinion gear 39 in a reverse direction so that the second guide plate 38 retracts in the direction B. Then, the second indexer 30 is restored to its original position.

According to the present invention, since printed paper is led via two movement tracks and clamped by first and second indexers which independently elevate to then be discharged to discharge trays, the printed paper can be rapidly discharged and sorted.

Also, only one of the first and second indexers may be used according to the printing speed or type. Although not shown, each indexer may be constructed such that it elevates by known means such as a guide rail, rather than a belt.

The above and other features of the invention including various and novel details of construction has been particularly described with reference to the accompanying drawings and pointed out in the following claims. It will be understood that the particular paper discharging apparatus embodying the invention is shown by way of illustration only and not as a limitation of the invention. The principles and features of this invention may be employed in varied and numerous embodiments without departing from the scope of the invention.

What is claimed is:

1. A paper discharging apparatus for a printer, the apparatus comprising:

a movement path having a first movement track and a second movement track for independently guiding paper printed in an image forming unit in a printer body;

a branching means for selectively allowing the printed paper to enter one of the first movement track and the second movement track;

a first indexer installed for movement in the printer body, for clamping a first sheet of paper having passed through the first movement track and moving to a first selected discharge tray to discharge the first sheet thereto;

a second indexer installed for movement in the printer body, for clamping a second sheet of paper having passed through the second movement track and moving to a second selected discharge tray to discharge the second sheet thereto;

first moving means for moving the first indexer;

second moving means for moving the second indexer; and a controller for controlling the first and the second moving means and the first and the second indexers.

2. The paper discharging apparatus according to claim 1, wherein each of the first and the second moving means comprises:

a pair of belts for supporting one of the first and the second indexers;

pulleys installed in an upper portion and a lower portion of the printer body to support the belts; and a stepping motor for rotating the pulleys.

3. The paper discharging apparatus according to claim 2, wherein the first indexer comprises:

first brackets fixed on the belts;

a pair of first clamping rollers rotatably mounted on the first brackets, for clamping the first sheet of paper and discharging the clamped first sheet of paper to the first discharge tray;

a first guide plate installed on the first brackets, for guiding the first sheet of paper discharged by the first clamping roller to the first discharge tray; and a first motor for driving the first clamping rollers.

4. The paper discharging apparatus according to claim 2, wherein the second indexer comprises:

second brackets fixed on the belts, a pair of second clamping rollers rotatably mounted on the second brackets, for clamping the second sheet of paper and discharging the clamped second sheet of paper to the second discharge tray;

a second guide plate installed on the second brackets for movement between (1) a retraced position in which the second guide plate is located away from the second discharge tray, and (2) an extended position in which the second guide plate is located toward the second discharge tray, for guiding the second sheet of paper discharged from the second clamping rollers to the second discharge tray;

a second motor for driving the second clamping rollers; and means for moving the second guide plate.

5. The paper discharging apparatus according to claim 4, wherein the moving means comprises:

a rack gear formed on a face of the second guide plate; and a pinion gear rotatably installed on the second brackets, engaged with the rack gear, and rotated by the second motor.

6. The paper discharging apparatus according to claim 1, wherein the branching means is a solenoid shutter for selectively opening and closing the first and the second movement tracks.

7. A paper discharging apparatus comprising:

a base;

a movement path provided on the base and having a first movement track and a second movement track for guiding sheets of paper;

a selector provided in the movement path that selectively allows the sheets of paper to enter one of the first movement track and the second movement track;

a first indexer installed for movement on the base, the first indexer for receiving a first sheet of paper that has passed through the first movement track and moving to a first selected discharge position to discharge the first sheet of paper; and a second indexer installed for movement on the base, the second indexer for receiving a second sheet of paper that has passed through the second movement track and moving to a second selected discharge position to discharge the second sheet of paper.

8. The paper discharging apparatus according to claim 7, further comprising:

a first mechanism adapted to move the first indexer;

a second mechanism adapted to move the second indexer; and a controller for controlling the first and the second moving mechanisms and the first and the second indexers.

9. The paper discharging apparatus according to claim 8, wherein each of the first and the second moving mechanisms comprises:

a pair of belts for supporting one of the first and the second indexers;

pulleys installed in an upper portion and a lower portion of the base to support the belts; and a stepping motor for rotating the pulleys.

10. The paper discharging apparatus according to claim 9, wherein the first indexer comprises:

first brackets fixed on the belts;

a pair of first clamping rollers rotatably mounted on the first brackets, for clamping the first sheet of paper and discharging the clamped first sheet of paper at the first discharge position;

a first guide plate installed on the first brackets, for guiding the first sheet of paper discharged by the first clamping rollers; and a first motor for driving the first clamping rollers.

11. The paper discharging apparatus according to claim 9, wherein the second indexer comprises:

second brackets fixed on the belts, a pair of second clamping rollers rotatably mounted on the second brackets, for clamping the second sheet of paper and discharging the clamped second sheet of paper at the second discharge position;

a second guide plate installed on the second brackets for movement between (1) a retraced position and (2) an extended position, for guiding the second sheet of paper discharged from the second clamping rollers;

a second motor for driving the second clamping rollers; and a third mechanism adapted to move the second guide plate.

12. The paper discharging apparatus according to claim 11, wherein the third mechanism comprises:

a rack gear formed on a face of the second guide plate; and a pinion gear rotatably installed on the second brackets, engaged with the rack gear, and rotated by the second motor.

13. The paper discharging apparatus according to claim 7, wherein the selector is a solenoid shutter for selectively opening and closing the first and the second movement tracks.

* * * * *